US008701917B2

(12) United States Patent
Ito et al.

(10) Patent No.: US 8,701,917 B2
(45) Date of Patent: Apr. 22, 2014

(54) OPENING DEVICE FOR STRAWS OF LIQUID FOOD CONTAINER

(75) Inventors: Koshaku Ito, Chiyoda-ku (JP); Yasuyuki Moriyama, Chiyoda-ku (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 174 days.

(21) Appl. No.: 13/380,299

(22) PCT Filed: Jun. 24, 2010

(86) PCT No.: PCT/JP2010/060785

§ 371 (c)(1),
(2), (4) Date: Dec. 22, 2011

(87) PCT Pub. No.: WO2011/001901

PCT Pub. Date: Jan. 6, 2011

(65) Prior Publication Data

US 2012/0091137 A1 Apr. 19, 2012

(30) Foreign Application Priority Data

Jun. 28, 2009 (JP) ..... 2009-153078

(51) Int. Cl.
*B65D 17/42* (2006.01)

(52) U.S. Cl.
USPC ..... 220/254.1; 215/250; 215/303; 220/277

(58) Field of Classification Search
USPC ..... 220/254.1, 277, 267, 265, 712, 260, 220/229, 705, 703, 266, 709, 711, 713, 220/367.1; 215/257, 250, 247, 249, 303, 215/229; 229/103.1
See application file for complete search history.

(56) References Cited

FOREIGN PATENT DOCUMENTS

| | | | |
|---|---|---|---|
| DE | 100 00 335 | A1 | 7/2000 |
| JP | 47-27017 | Y1 | 8/1972 |
| JP | 58-136425 | U | 9/1983 |
| JP | 2002-362548 | A | 12/2002 |
| JP | 2005-212864 | A | 8/2005 |
| JP | 2008-155948 | A | 7/2008 |
| JP | 2010-116168 | | 5/2010 |

OTHER PUBLICATIONS

JP_2010116168.pdf.*
International Search Report (PCT/ISA/210) issued on Sep. 14, 2010, by Japanese Patent Office as the International Searching Authority for International Application No. PCT/JP2010/060785.

* cited by examiner

*Primary Examiner* — Mickey Yu
*Assistant Examiner* — Allan Stevens
(74) *Attorney, Agent, or Firm* — Buchanan Ingersoll & Rooney P.C.

(57) ABSTRACT

An opening device for straws for liquid food containers enables a straw hole to be easily opened by piercing with a straw while avoiding easy leakage or breakage due to external force from vibrations or the like during delivery. The device includes a base and a main body, formed from packaging material, both sides of the base paper of which have been laminated with thermoplastic resin and a top, formed from thermoplastic resin, which is joined to the top of the main body. An opening of the opening device for straws, integrated with the top section, is provided with a plurality of step sections and between-step sections on the front and back surfaces. The front between-step sections and the back between-step sections overlap at the edge of each of the step sections, with the thickness at the edge of the between-step sections being thinner than that of the steps.

6 Claims, 10 Drawing Sheets

(a)

(b)

OPENING DEVICE FOR STRAWS OF LIQUID FOOD CONTAINER

FIELD OF THE INVENTION

This invention relates to an opening device for straws of a liquid food container which fills up and packages beverages etc.

BACKGROUND ART

Conventionally, there are opening devices for straws formed in the thermoplastics lid of the paper container filled up with liquid food, such as cow's milk and soft drinks. In the opening device for straws, as for the packaging material of the liquid food container, a paper substrate is covered by an outer layer and an inner layer of thermoplastics, a straw hole is covered with thermoplastics and a straw hole sealing part is formed. The straw hole sealing part is formed by injection molding. In the straw hole sealing part, it is required for the straw to penetrate easily without sliding, and for the straw hole sealing part to be soft and to keep the tip of the straw from bending, when sticking the straw.

Therefore, a thin-walled groove portion is formed in the straw hole sealing part to such an extent that sealing performance is not damaged. (Reference patent documents 1) Patent documents 1: JP,2002-362548,A

DISCLOSURE OF THE INVENTION

Problems to be Solved by the Invention

Although the straw hole sealing part can be easily penetrated with a straw by using the conventional thin-walled groove portion, there are risks that the thin-walled groove portion may break by shock etc. in carrying/distribution process of the liquid food container. If thickness of the thin-walled groove portion is made thin, the straw hole sealing part cannot inconveniently penetrate easily.

The object of the present invention is to provide an opening device for a straw of a liquid food container being capable of easily opening a straw hole by sticking without leaking and breaking by external forces of vibrations and the like at the transportation, in the liquid food container having a thermoplastic resin top formed in an upper end edge of a body of the packaging material laminated on paper substrate with thermoplastic resin.

Means to Solve the Problem

An opening device for straws of a liquid food container of this invention is the opening device for straws of a liquid food container which comprises a bottom and a main body formed with an packaging material laminated both sides of a paper substrate with thermoplastic resin, and a top formed with thermoplastic resin and joined to a upper end of the main body; is characterized by that

- the opening of the opening device for straws is integrally formed with the top and comprises a plurality of steps and level differences on the front side and the back side of the opening, the level differences on the front side and the level differences on the back side are formed at edges of the level differences on the back and the front with overlaps,
- lengths of the overlaps of edges of the level differences are thinner than thickness of the steps, the level differences are easy fracture parts,

- the steps have 190%-650% of thickness to the lengths of the overlaps of the edges, and the overlap of the edge is 0.09-0.11 millimeter in length.

In the preferable embodiment of this invention, the step on the front side of the opening is flat on the surface, and the step on the back side of the opening is flat on the surface.

In the preferable embodiment of this invention, the step on the front side of the opening is roundish on the surface, and the step on the back side of the opening is roundish on the surface.

In the preferable embodiment of this invention, the step on the front side of the opening is rounded on the surface, and the step on the back side of the opening is flat on the surface.

In the preferable embodiment of this invention, the projection is formed in one of the steps on the front side.

In the preferable embodiment of this invention, the thermoplastic resin which forms the top, and the thermoplastic resin laminated on the paper substrate of the packaging material consist of the same or different kind of low density polyethylene.

Effect of the Invention

According to the above present invention, the following operation functions are exhibited and an advantageous effect is acquired.

The liquid food container of the opening device for straws in this invention comprises the bottom and the main body formed with the packaging material laminated the both sides of the paper substrate with thermoplastic resin, and the top joined to the upper end of the main body, and formed, for example with injection molding with thermoplastic resin.

Since the top is formed with thermoplastic resin, the shape and the thinness can be controlled/designed easily.

In the feature of the present invention, the opening of the opening device for straws is integrally formed with the top and comprises a plurality of steps and level differences on the front side and the back side of the opening.

When the straw is stuck into the opening, the step on the front side is touched first, and it slides easily, and moves to the level difference, and the tip of the straw stops there. When force is applied to the level difference, it is pushed into the inside of the liquid food container so that the opening may curve, and the edges of the level differences of the both sides covering the level difference on the back side which adjoins from the level difference on the front side are extended gradually, and the straw tip is further stuffed into the portion.

In the feature of the present invention, since the thickness of the edge of the level difference is thinner than the thickness of the step and the level difference is an easy fracture part, the level difference is fractured by the straw tip further stuffed in. The straw is further stuffed in and fracture area further spreads as a starting point of the fracture point.

The edge of the level difference is protected by the step, and since the step is thickly, an opening is not damaged nor broken carelessly.

The opening is not simply fractured by an external force, such as vibration at the delivery, and does not leak, and the thrust of the straw can open the straw hole easily.

In the feature of the present invention, the thickness of the edge of the level difference is thinner than the thickness of the step, and the step has 190%-650%, preferably 190%-350% of thickness to the length of the overlap of the edge.

When the step has thinner thickness than 190%, there is a risk that the step may embrittle relatively and the step may break with the straw.

On the other hand, when the step has thicker thickness than 650%, there is a risk that the step has too much thickness, and the thickness may stop to open the whole opening after fracturing from a level difference.

In the feature of the present invention, the overlap of the edges is 0.09-0.11 millimeter in length.

In the liquid food container in which the top of thermoplastic resin is formed, by an external force, such as a shock at the delivery, the opening does not break simply and does not leak with this length of the overlap of the edges, and the straw hole is easily opened by the thrust of the straw.

In the preferable embodiment of this invention, the step on the front side of the opening is flat on the surface, and the step on the back side of the opening is flat on the surface.

The design is simple and advantageous to manufacture of the mold etc.

In the preferable embodiment of this invention, the step on the front side of the opening is roundish on the surface, and the step on the back side of the opening is roundish on the surface.

Since the step is roundish on the surface and the straw point is guided to the level difference on the front side, it is advantageous to breaking with the straw. Since the step on the back side is roundish on the surface, it can raise mechanical strength with the swelling.

In the preferable embodiment of this invention, the step on the front side of the opening is roundish on the surface, and the step on the back side of the opening is flat on the surface.

This embodiment can produce the same effect as the above-mentioned embodiment.

In the preferable embodiment by which the projection is formed in the front side of the step, the consumers can stick the straw into the mark of the projection, and the straw tip from the projection can slide on the step, can run against the level difference, can stop there, and can open the opening easily.

EXPLANATION OF REFERENCES

Figure 1:
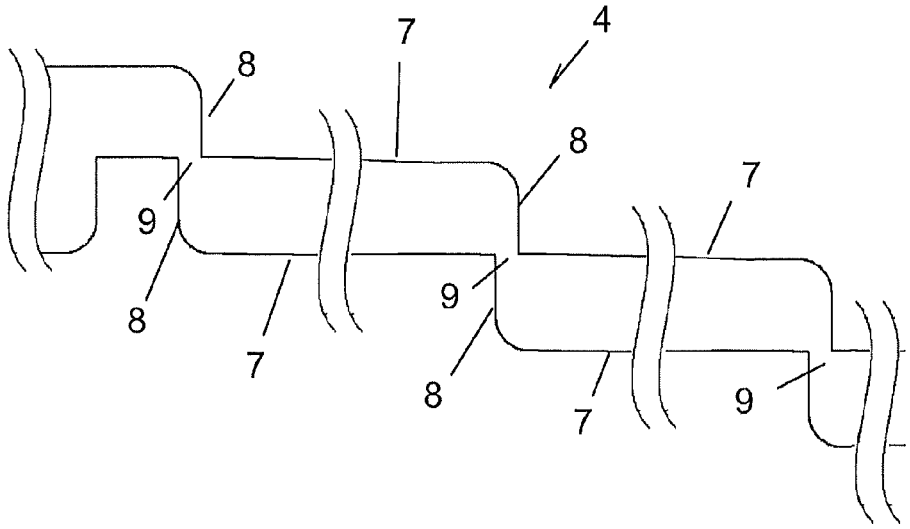
FIG. 1 A sectional view of the opening of Examples 1, 2, and 4 of the opening device for the straws according to this invention.

1 . . . Container
2 . . . Main Body of the Container
3 . . . Top
4 . . . Opening
5 . . . Lid
7 . . . Step
8 . . . Level Difference
9 . . . Edge

THE BEST MODE FOR THE INVENTION

Hereinafter, the embodiment of the invention is described in detail, referring to the drawings. The appearance of the opening device for the container and the straws according to this embodiment is explained by the reference example shown in FIG. 2 (the side view (a), the front view (b), the top view (c), and the bottom view (d)). This container consists of the main body 2 of the paper container, and the dome-like container top 3 of the thermoplastic resin joined to the upper end of the main body 2 and formed by injection, and the lid 5 for the spouts is integrally formed in the center of the top of the container top 3. The opening 4 is integrally formed with the lid 5, and is formed in shape dented from the top face of the lid.

Figure 2:
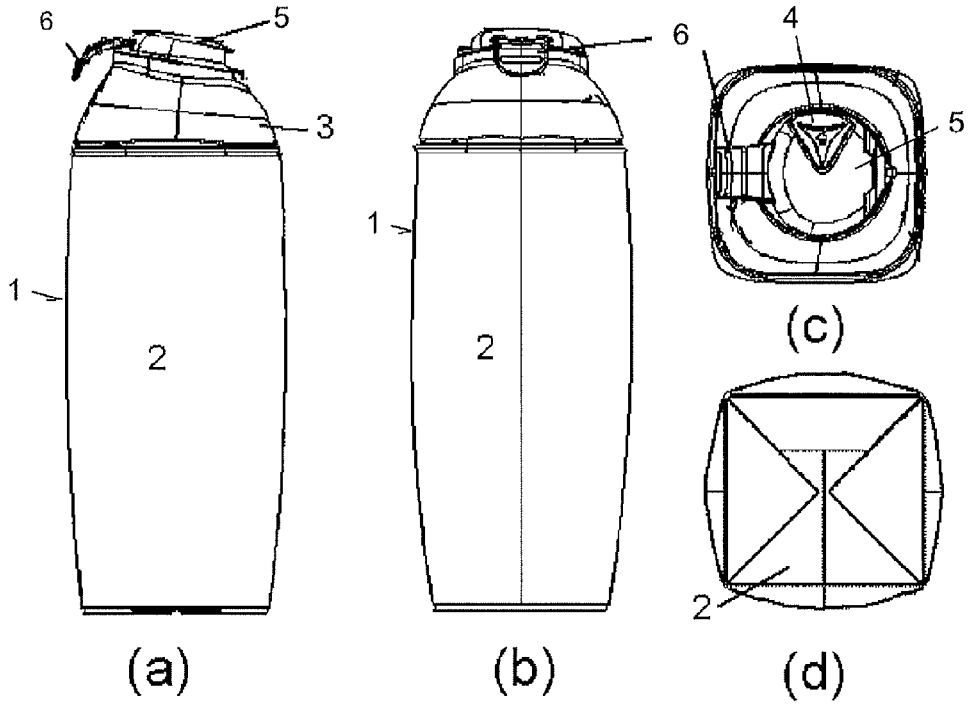
FIG. 2 A side view, a front view, a top view, and a bottom view of the reference example showing the appearance of the opening device for the straws, and the liquid food container.

The whole container is outlined with reference to the reference example of FIG. 2. The main body 2 is obtained from the packaging material in which the thermoplastic resin is laminated in both sides of the paper substrate. As shown in FIG. 2 (*d*), the tube shape packaging material is transversally sealed, the flaps and fins formed with the transversal seal are folded up, and the bottom of the main body 2 is formed.

In the center of the top of the container top 3, the lid 5 for the spouts is formed integrally. At the time of usages (unsealing) of the lid, the gripper 6 is pulled up, the fragile weak line (thin part) surroundings around the outer edge of the lid 5 is torn, the lid 5 is pulled up, and the spout is opened.

In the non-use or using in combination of the spout, the straw hole (opening device for the straws) is used. The opening 4 of the opening device for the straws is integrally formed with the top 3 (and lid 5).

In this embodiment, the thermoplastic resin by which the top is formed, and the thermoplastic resin which is laminated on the paper substrate of an packaging material include for example, polyolefin resin, such as polyethylene, polypropylene, and ethylenic copolymer, co-extrusion polymer or blend polymer containing low density polyethylene (LDPE), linear low density polyethylene (LLDPE), medium density polyethylene, and polyethylene, linear low density polyethylene (mLLDPE) having the narrow molecular weight distribution polymerized using the metallocene catalyst, and blend polymer containing at least mLLDPE etc.

Preferably, the thermoplastic resin consists of the same kind or different kind of low density polyethylene.

Figure 6:
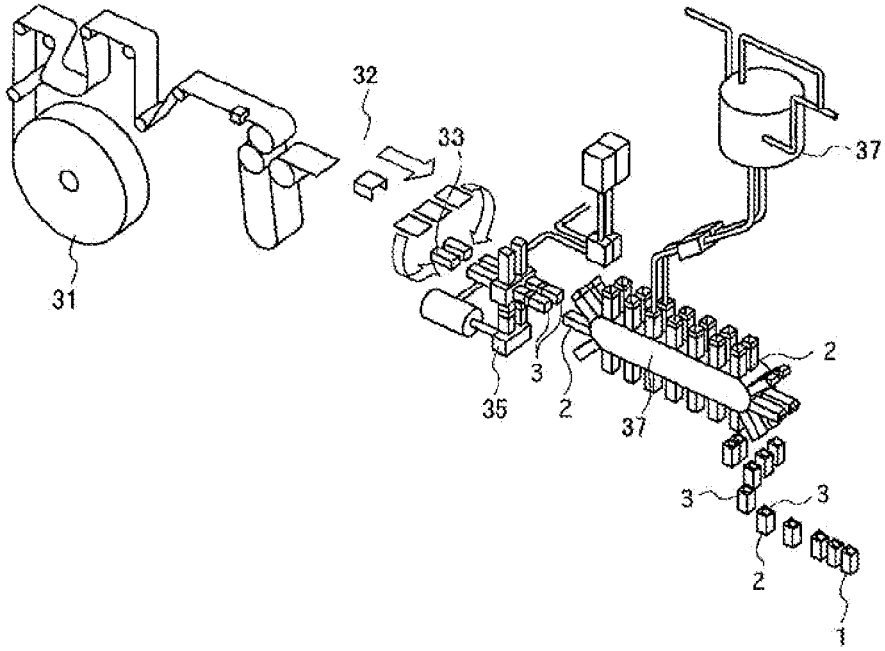
FIG. 6 An outline view showing the manufacturing process of the liquid food container of the reference example.

Container 1 of Example is obtained by an apparatus etc. which manufactures the composite container shown, for example in FIG. 6. Web-like lamination paper packaging material 31 is cut out into the predetermined configuration 32, and container sleeve 33 having longitudinal seal to the container lengthwise direction is obtained. Container top 3 having thin container wall is formed in the top end of the main body 2 with plastic injection molding 35. From the opening of the container bottom of the bottom end of the sleeve, a food product is filled up with the filling apparatus 37, and the bottom is sealed. The container 1 having the main body 2 and the top 3 is obtained.

As shown in FIG. 1 of the sectional view of the opening of Examples 1, 2, and 4, in this embodiment, the opening 4 of the opening device for the straws is integrally formed with top 3, and has a plurality of steps 7 and level differences 8 on the front side and the back side of the opening 4, and the level difference on the front side and the level difference on the back side are overlapped and formed at the back and front of the edge 9 of the level differences.

In the embodiment of this invention, the thickness of the edge 9 of the level difference 8 is thinner than the thickness of the step 7, and the level difference 8 is the easy fracture part.

Figure 4:
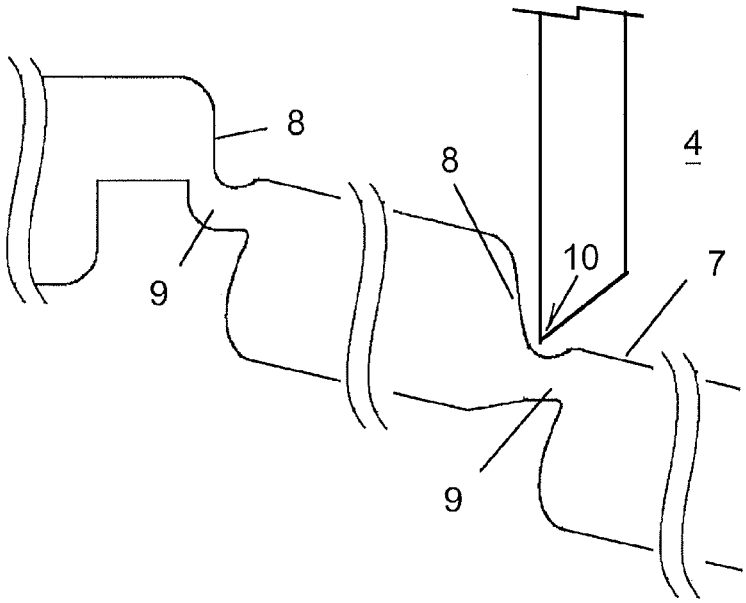
FIG. 4 A sectional view showing breaking operation of the opening of an example of the opening device for the straws according to this invention.

As shown in FIG. 4, when the straw is stuck into the opening 4, although the tip 10 of the straw touches to the step 7 on the front side first, it slides easily, and moves to the level difference 8, and it stops there. Since the force is applied to the level difference 8, the opening 4 is stuffed into the inside of the liquid food container so that it may curve. The edge 9 of both level differences ranging from the level difference 8 on the front side to the level difference 8 on the adjacent back side is extended gradually, and the straw tip 10 is further stuffed into the portion 9. The edge 9 of the level difference is fractured by the further stuffed-in straw tip 10. The straw is further pushed at the fractured point as the starting point, and the fractured surface further spreads.

Figure 3:
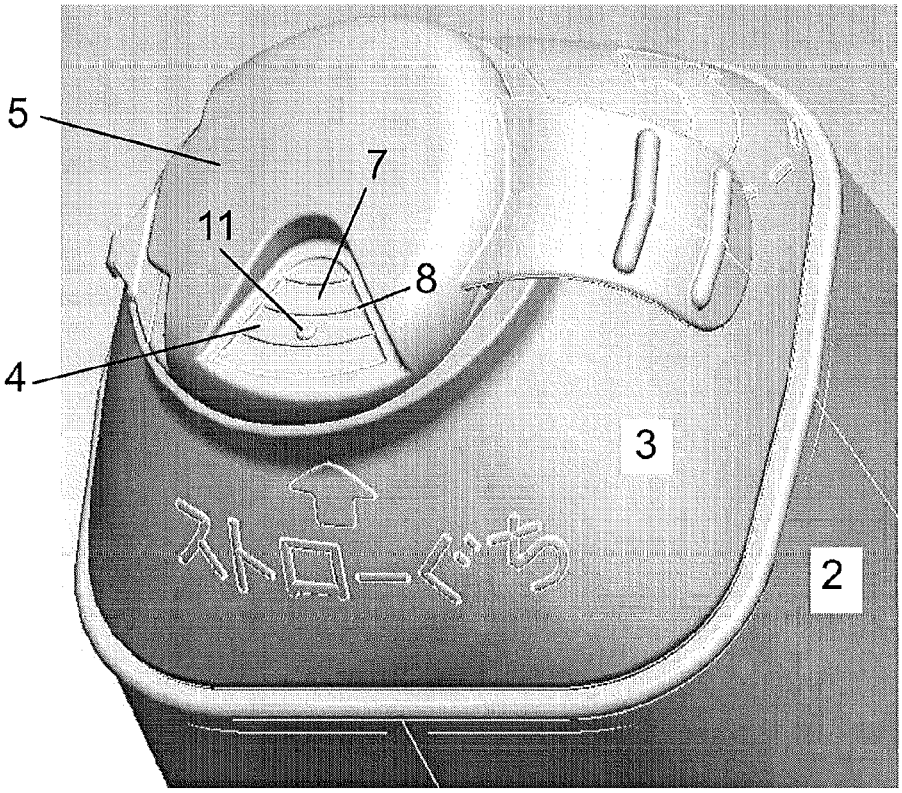
FIG. 3 An outline view showing Example 1 of the top of the liquid food container of this invention.

The appearance of the container, and the opening device for straws according to Example 1 is shown in FIG. 3. The container consists of the paper main body 2 and the dome-like container top 3 of thermoplastic resin joined to the upper end of the main body 2, and formed by injection, and the lid 5 for a spout is integrally formed in the center of the top of container top 3. The opening 4 is integrally formed with the lid 5, and is formed in shape dented from the top face of the lid. In this embodiment, the bottom surface of the dent of the opening 4 comprises three flat surface steps 7, and a plurality of the level differences 8 on the back side and the front side at the bottom surface (the back side not shown in FIG. 3).

In Example 1 shown in FIG. 3, the flat surface shape of the opening 4 is the fan shape spreading in the outer edge of the lid 5. The level difference 8 is formed in parallel with the circular arc of a fan shape, and the step 7 also has the shape of a partial fan shape. Since the flat surface shape of the opening 4 is the fan shape which spreads in the outer edge of the lid 5, the straw can be certainly struck not in the center section but in the circumference part of the dome-like lid 5 of the dome-like lid 5 which is easy to deform relative. Since the straight-line wall contributed to reinforcement is formed to the edge of the opening 4 from the center of the lid, the mechanical strength of the top and the lid is reinforced.

The level difference 8 is formed in parallel with the circular arc of fan shape, and the breaking easily level difference 8 certainly traps the tip of the straw.

Figure 14:
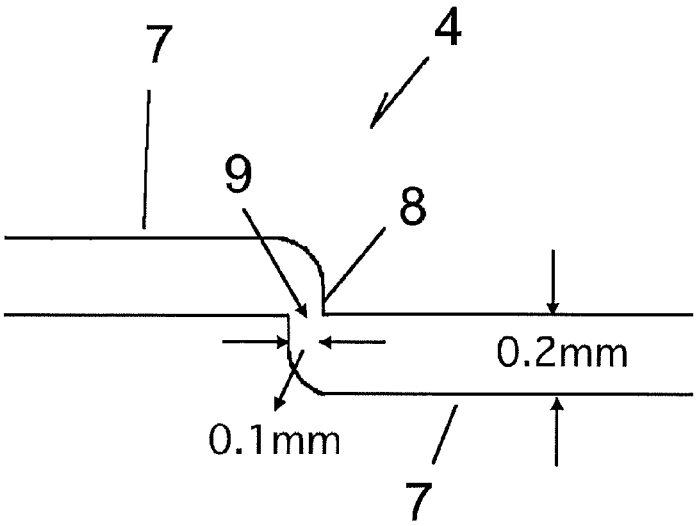
FIG. 14 A sectional view showing the dimensions of Examples 1, 2, and 4 of the opening of the opening device for the straws of this invention.

As shown in FIG. 14, in Example 1, the thickness of the edge 9 of the level difference 8 is 0.1 mm. The thickness of the step 7 is 0.2 mm. The thickness of the edge of the level difference is thinner than the thickness of the step, and the step has 200% of thickness to the length of the overlap of the edge. The level difference 8 is the easy fracture part.

Figure 5:
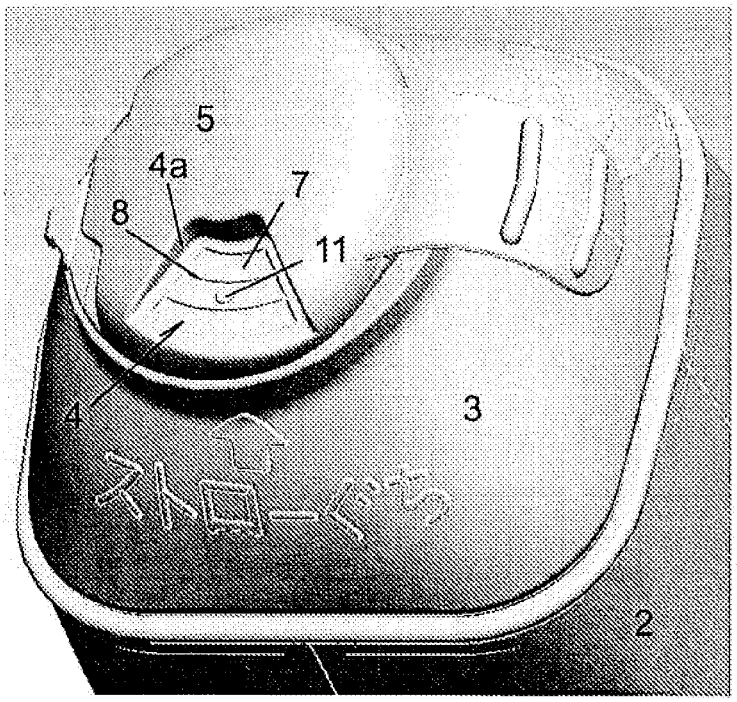
FIG. 5 An outline view showing Example 2 of the top of the liquid food container of this invention.

The appearance of the opening device for the container and the straws according to this Example 2 is shown in FIG. 5. The container consists of the main body 2 of the paper container, and the dome-like container top 3 of the thermoplastic resin which is joined to the upper end of the main body 2 and is formed by injection, and the lid 5 for the spouts is integrally formed in the center top of the container top 3. The opening 4 is integrally formed with the lid 5, and is formed in shape dented from the top face of the lid.

In this embodiment, the bottom surface of the dent of the opening 4 comprises three flat surface steps 7, and three level differences 8 on the back side and the front side at the bottom surface (the back side not shown in FIG. 5).

In the embodiment shown in FIG. 5, the flat surface shape of the opening 4 is a fan shape which spreads in the outer edge of the lid 5, and lacks the center section of the lid 5. The level difference 8 is formed in parallel with the circular arc of the fan shape, and the step 7 has the shape of the partial fan shape.

Since the flat surface shape of the opening 4 is the fan shape which spreads in the outer edge of the lid 5, the straw can be certainly struck not in the center section but in the circumference part of the dome-like lid 5 of the dome-like lid 5 which is easy to deform relative.

Since the straight-line wall contributed to reinforcement is formed to the edge from the center of the lid, the mechanical strength of the top and the lid is reinforced. Any level difference which has the low unsealing possibility and does not contribute to unsealing is not formed at the center section and near the fan shape of the lid 5. In Example 2, since the fan shape is the shape missing in the center section of the lid 5, it can avoid that the consumers strike the straw in the needless part, and take time in unsealing.

The level difference 8 is formed in parallel with the circular arc of fan shape, and the breaking easily level difference 8 certainly traps the tip of the straw.

As shown in FIG. 14, in Example 2, the thickness of the edge 9 of the level difference 8 is 0.1 mm. The thickness of the step 7 is 0.2 mm. The thickness of the edge of the level difference is thinner than the thickness of the step, and the step has 200% of thickness to the length of the overlap of the edge. The level difference 8 is the easy fracture part.

Figure 7:
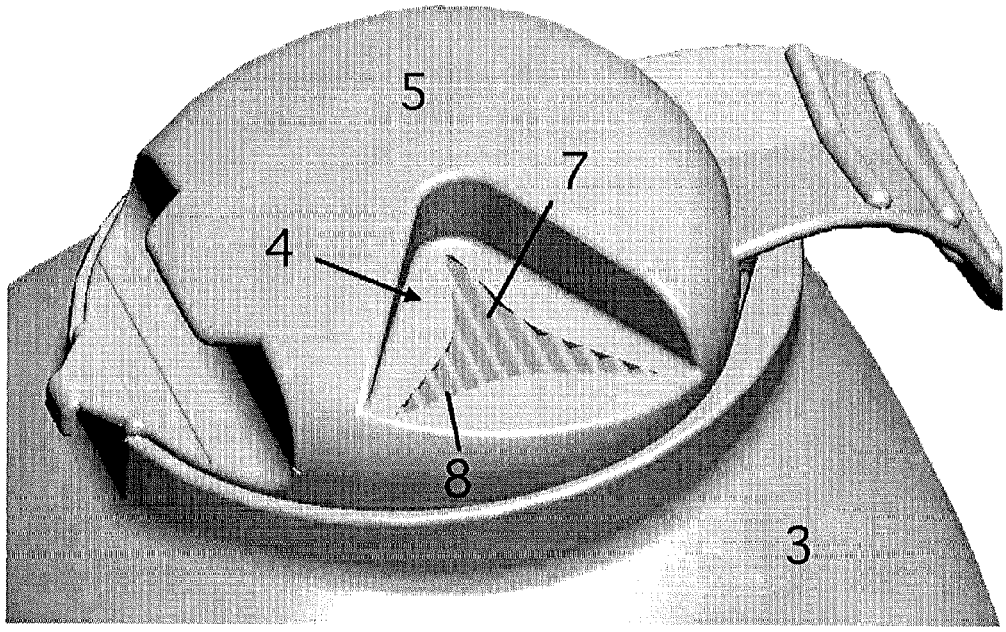
FIG. 7 An outline view showing the reference example 3 of the top of the liquid food container.

The appearance of the opening device for the container and the straws according to the reference example 3 is shown in FIG. 7. This container consists of the main body 2 of the paper container, and the dome-like container top 3 of the thermoplastic resin which is joined to the upper end of the main body 2, and is formed by injection, and the lid 5 for spouts is integrally formed in the center of the container top 3. The opening 4 is integrally formed with the lid 5, and is formed in shape dented from the top face of the lid.

In this embodiment, the bottom surface of the dent of the opening 4 comprise a plurality of roundish surface steps 7 and level differences 8 on the back side and the front side at the bottom surface (the back side not shown in FIG. 7).

Figure 15:
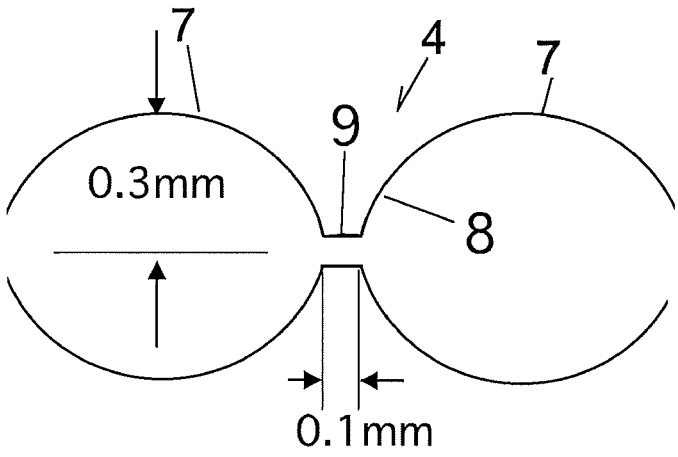
FIG. 15 A sectional view showing the dimensions of the reference example 3 of the opening of the opening device for the straws.

As shown in FIG. 15, in the reference example 3, the thickness of the edge 9 of the level difference 8 is 0.1 mm. The thickness of the step 7 is 0.3 mm. Unlike this invention, the steps 7 by both sides of the back and front has completely overlapped, and there is no overlap in the edges 9 of the level differences 8. As compared with Examples, by external force, such as the shock at the delivery, the opening is fractured simply and leaks easily.

Figure 8:
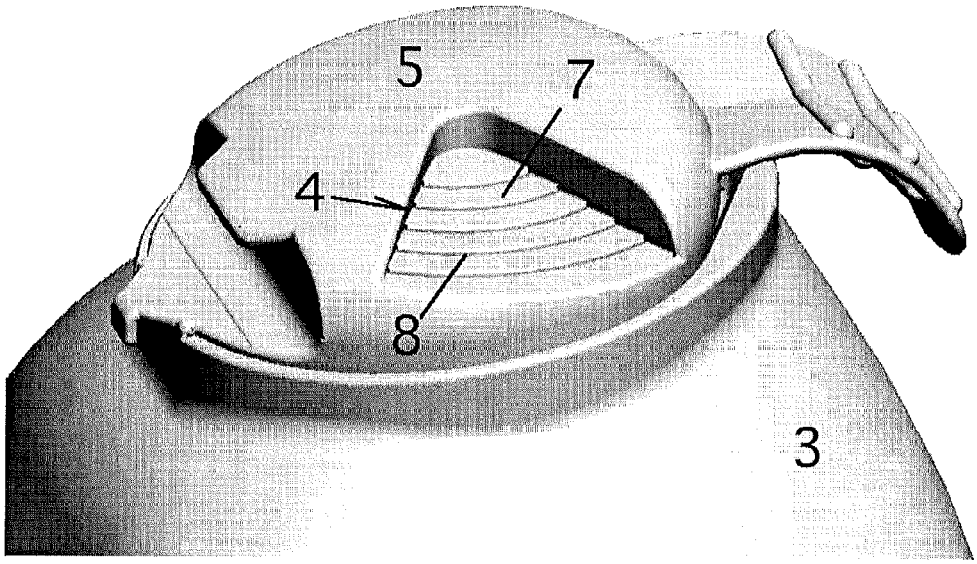
FIG. 8 An outline view showing Example 4 of the top of the liquid food container of this invention.

The appearance of the container, and the opening device for straws according to Example 4 is shown in FIG. 8. This container consists of the main body 2 of the paper container, and the dome-like container top 3 of the thermoplastic resin which is joined to the upper end of the main body 2, and is formed by injection, and the lid 5 for the spouts is integrally formed in the center of the container top 3. The opening 4 is integrally formed with the lid 5, and is formed in shape dented from the top face of the lid.

In this embodiment, the bottom surface of the dent of the opening 4 comprises six flat surface steps 7, and five level differences 8 on the back side and the front side at the bottom surface (the back side not shown in FIG. 8).

As shown in FIG. 14, in Example 4, the thickness of the edge 9 of the level difference 8 is 0.1 mm. The thickness of the step 7 is 0.2 mm. The thickness of the edge of the level difference is thinner than the thickness of the step, and the step has 200% of thickness to the length of the overlap of the edges. The level difference 8 is the easy fracture part.

Figure 9:
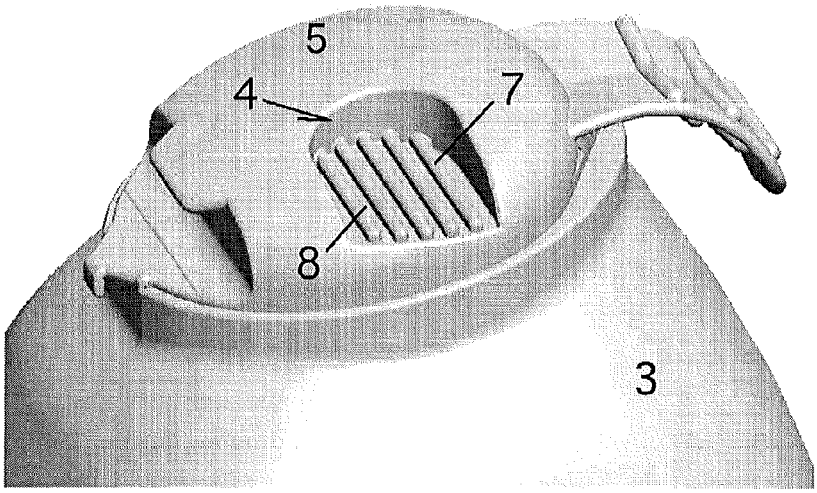
FIG. 9 An outline view showing Example 5 of the top of the liquid food container of this invention.

The appearance of the container, and the opening device for the straws according to Example 5 is shown in FIG. 9. This container consists of the main body 2 of the paper container, and the dome-like container top 3 of the thermoplastic resin which is joined to the upper end of the main body 2, and is formed by injection, and the lid 5 for the spouts is integrally formed in the center of the container top 3. The opening 4 is integrally formed with the lid 5, and is formed in shape dented from the top face of the lid.

In this embodiment, the bottom surface of the dent of the opening 4 comprises five roundish surface steps 7, and a plurality of level differences 8 on the back side and the front side at the bottom surface (the back side not shown in FIG. 9).

Figure 16:
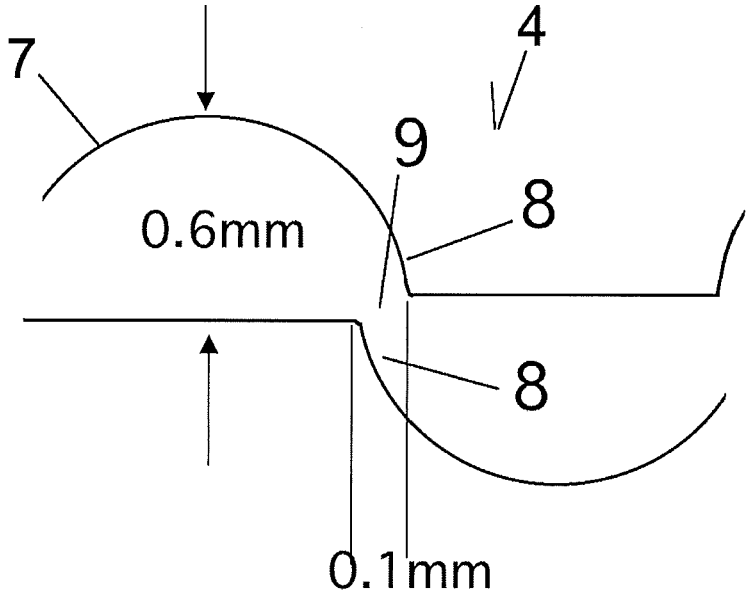
FIG. 16 A sectional view showing the dimensions of Example 5 of the opening of the opening device for the straws of this invention.

As shown in FIG. 16, in Example 5, the thickness of the edge 9 of the level difference 8 is 0.1 mm. The thickness of the step 7 is 0.6 mm. The thickness of the edge of the level difference is thinner than the thickness of the step, and the step has 600% of thickness to the length of the overlap of the edge. The level difference 8 is the easy fracture part.

Figure 10:
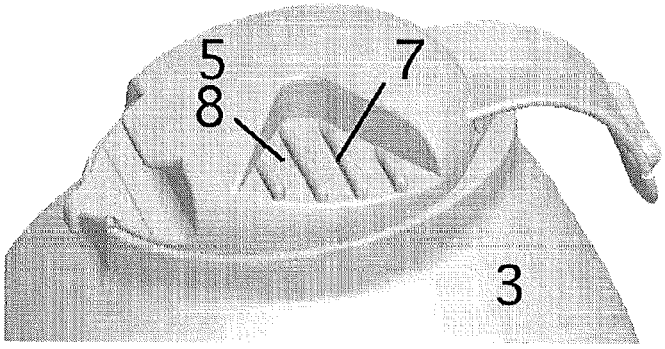
FIG. 10 An outline view showing Example 6 of the top of the liquid food container of this invention.
Figure 10:
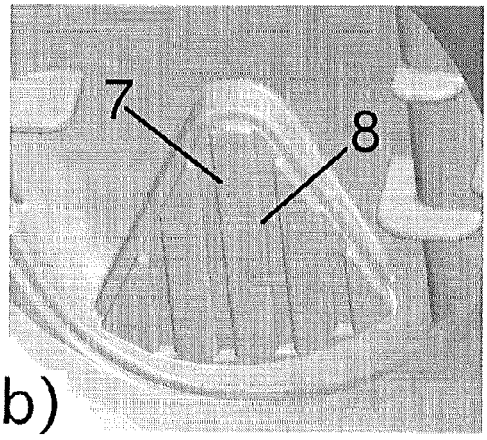

The appearance of the container, and the opening device for the straws according to Example 6 is shown in FIG. 10 (*a*). This container consists of the main body of the paper container, and the dome-like container top 3 of the thermoplastic resin which is joined to the upper end of the main body and formed by injection, and the lid 5 for the spouts is integrally formed in the center of the container top 3. The opening 4 is integrally formed with the lid 5, and is formed in shape dented from the top face of the lid.

In this embodiment, the bottom surface of the dent of the opening 4 comprises four roundish surface steps 7, and a plurality of level differences 8 on the front side at the bottom surface. On the back side shown in FIG. 10 (*b*), it has the flat step 7 and the level difference 8.

Figure 17:
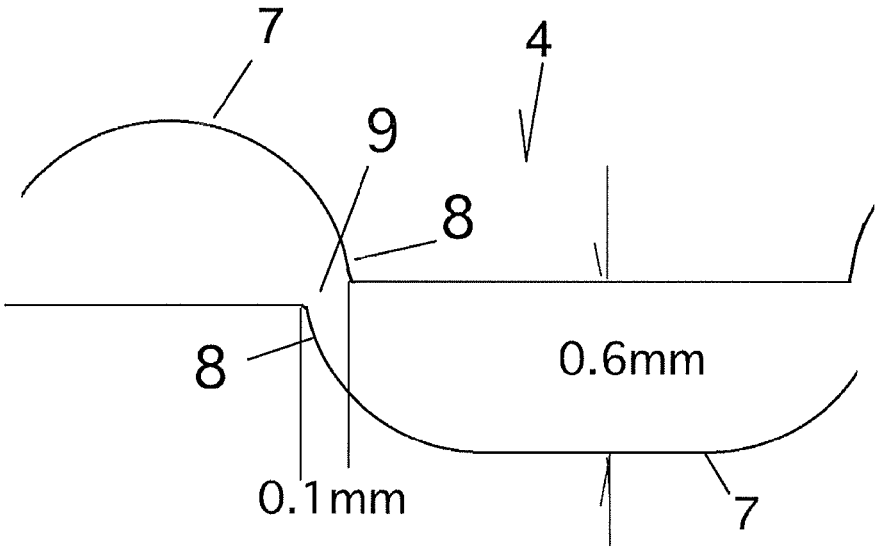
FIG. 17 A sectional view showing the dimensions of Example 6 of the opening of the opening device for the straws of this invention.

As shown in FIG. 17, in Example 6, the thickness of the edge 9 of the level difference 8 is 0.1 mm. The thickness of the step 7 on the front side and the back side is 0.6 mm. The thickness of the edge of the level difference is thinner than the thickness of the step, and the step has 600% of thickness to the length of the overlap of the edge. The level difference 8 is the easy fracture part.

Figure 11:
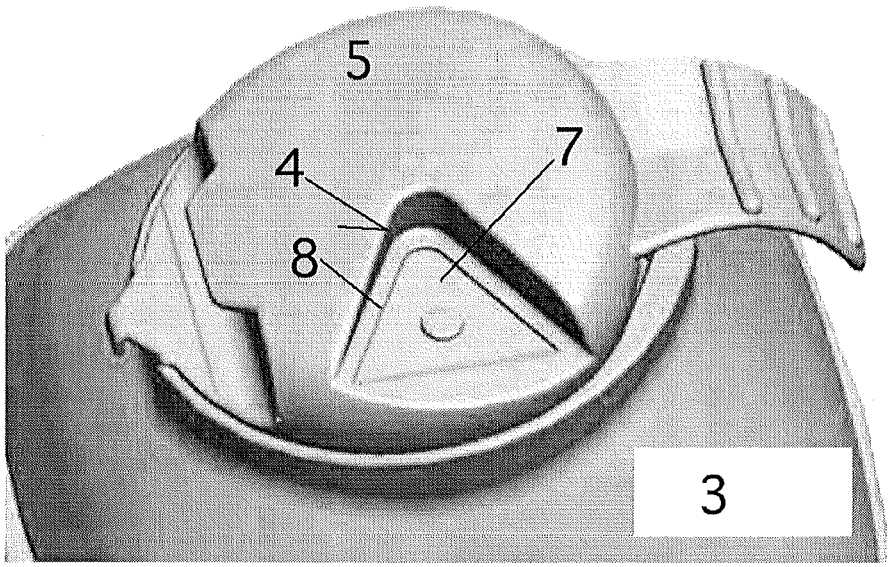
FIG. 11 An outline view showing the reference example 7 of the top of the liquid food container.

The appearance of the container, and the opening device for the straws according to the reference example 7 is shown in FIG. 11. This container consists of the main body 2 of the paper container, and the dome-like container top 3 of the thermoplastic resin which is joined to the upper end of the main body 2, and is formed by injection, and the lid 5 for the spouts is integrally formed in the center of the container top 3. The opening 4 is integrally formed with the lid 5, and is formed in shape dented from the top face of the lid.

In this embodiment, the bottom surface of the dent of the opening 4 comprises one flat surface steps 7, and one level difference 8 on the back side and the front side at the bottom surface (the back side not shown in FIG. 11).

Figure 18:
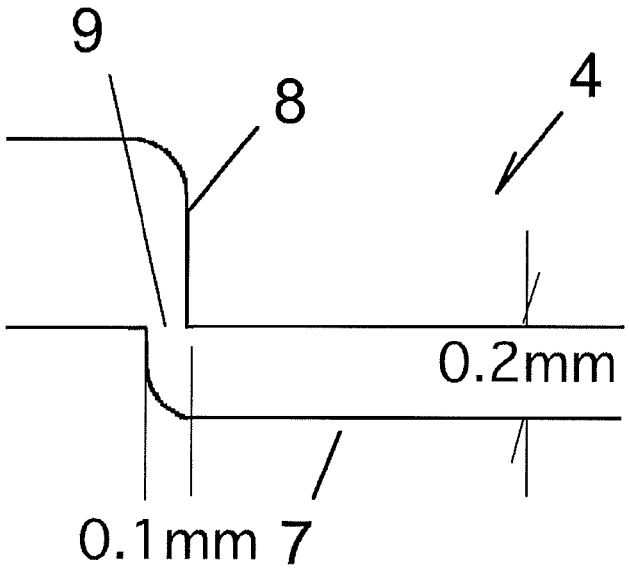
FIG. 18 A sectional view showing the dimensions of the reference example 7 of the opening of the opening device for the straws.

As shown in FIG. 18, in this reference example 7, the thickness of the edge 9 of the level difference 8 is 0.1 mm. The thickness of the step 7 is 0.2 mm. Unlike this invention, the number of the steps 7 by the side of the back and front is one, respectively, and the level difference 8 is one. Since the number of the step and the level difference is the singular number as compared with the example, breaking with the straw is difficult.

Figure 12:
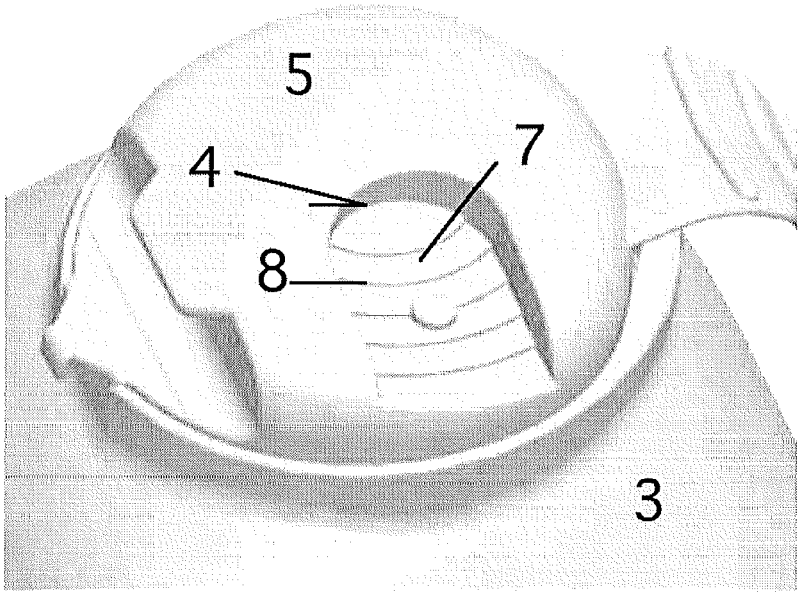
FIG. 12 An outline view showing Example 8 of the top of the liquid food container of this invention.

The appearance of the container, and the opening device for the straws according to Example 8 is shown in FIG. 12. This container consists of the main body of the paper container, and the dome-like container top 3 of the thermoplastic resin which is joined to the upper end of the main body and formed by injection, and the lid 5 for the spouts is integrally formed in the center of the container top 3. The opening 4 is integrally formed with the lid 5, and is formed in shape dented from the top face of the lid. In this embodiment, the bottom surface of the dent of the opening 4 comprises some flat surface steps 7, and a plurality of level differences 8 on the back side and the front side at the bottom surface (the back side not shown in FIG. 12).

Figure 19:
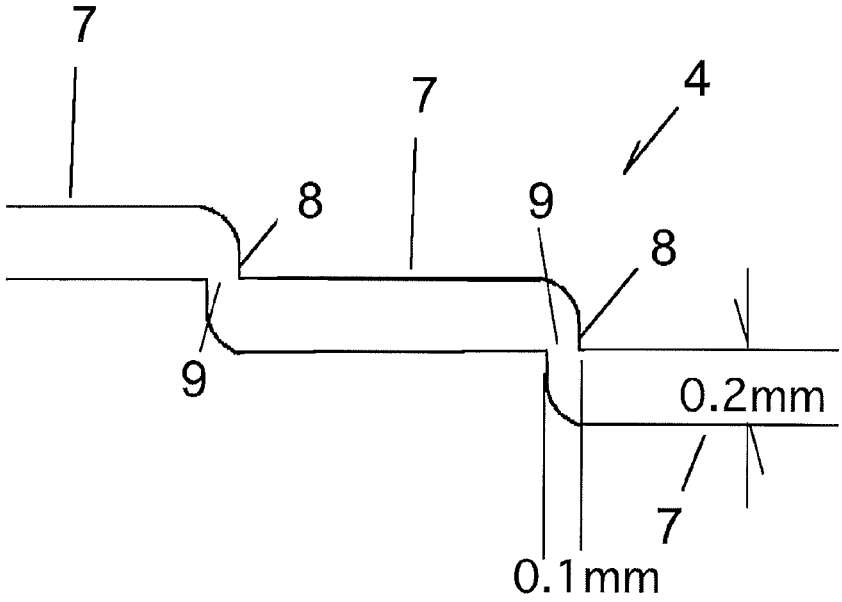
FIG. 19 A sectional view showing the dimensions of Example 8 of the opening of the opening device for the straws of this invention.

As shown in FIG. 19, in Example 8, the thickness of the edge 9 of the level difference 8 is 0.1 mm. The thickness of the step 7 is 0.2 mm. The thickness of the edge of the level difference is thinner than the thickness of the step, and the step has 200% of thickness to the length of the overlap of the edge. The level difference 8 is the easy fracture part.

Figure 13:
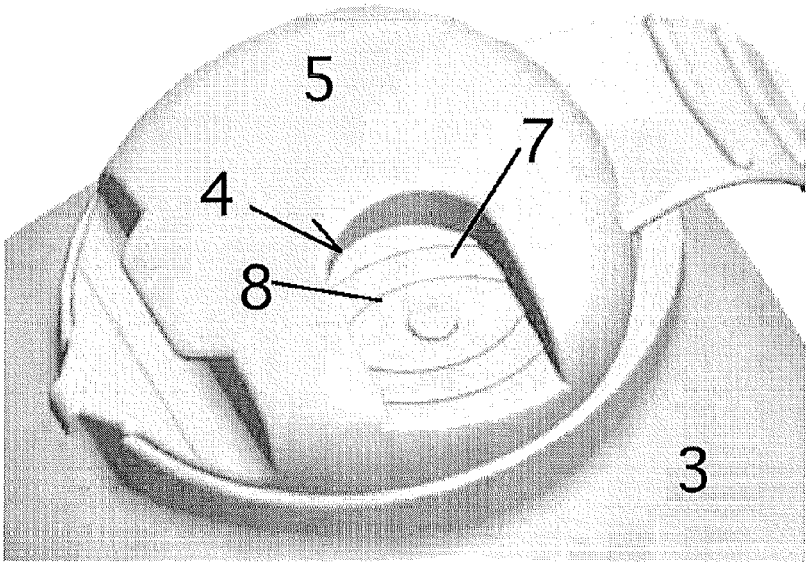
FIG. 13 An outline view showing Example 9 of the top of the liquid food container of this invention.

The appearance of the container, and the opening device for the straws according to Example 9 is shown in FIG. 13. This container consists of the main body of the paper container, and the dome-like container top 3 of the thermoplastic resin which is joined to the upper end of the main body and formed by injection, and the lid 5 for the spouts is integrally formed in the center of the top of the container top 3. The opening 4 is integrally formed with the lid 5, and is formed in shape dented from the top face of the lid.

In this embodiment, the bottom surface of the dent of the opening 4 comprises some flat surface steps 7, and a plurality of level differences 8 on the front side at the bottom surface.

Figure 20:
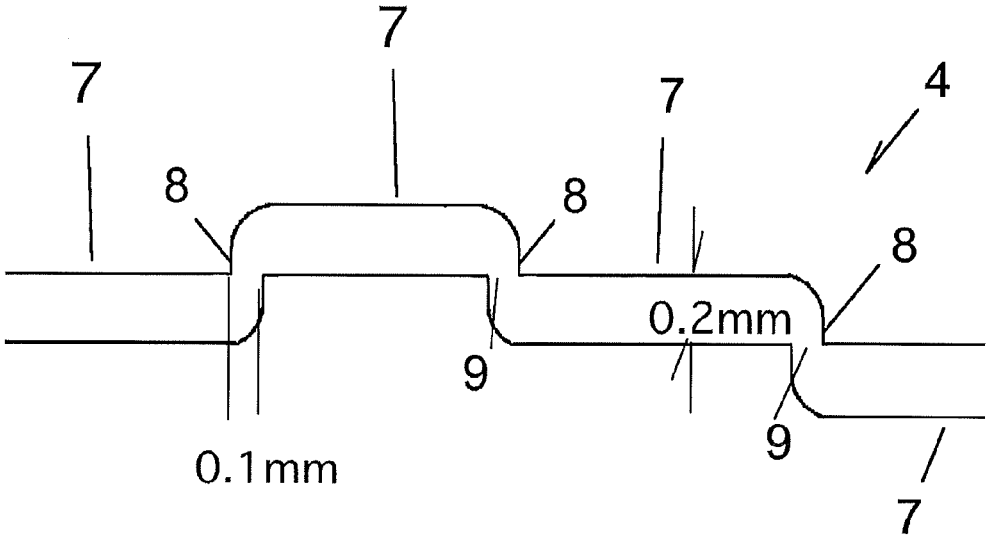
FIG. 20 A sectional view showing the dimensions of Example 9 of the opening of the opening device for the straws of this invention.

As shown in FIG. 20, in Example 9, the thickness of the edge 9 of the level difference 8 is 0.1 mm. The thicknesses of the steps 7 on the front side and the back side are 0.2 mm. The thickness of the edge of the level difference is thinner than the thickness of the step, and the step has 200% of thickness to the length of the overlap of the edge. The level difference 8 is the easy fracture part.

In Examples, such as Examples 1 and 2, the opening 4 of the opening device for the straws is integrally formed with the top 3 (and lid 5). The projection 11 is formed in the front side of the step 7.

As mentioned above, the edge of the level difference is protected by the step, and since the step is thickly, an opening is not damaged nor broken carelessly.

The opening is not simply fractured by an external force, such as vibration at the delivery, and does not leak, and the thrust of the straw can open the straw hole easily. The consumers can stick the straw into the mark of the projection, and the straw tip from the projection can slide on the step, can run against the level difference, can stop there, and can open the opening easily.

The present invention is not limited to the above-mentioned embodiment, and it is possible to make it deform variously based on the object of the present invention, and it does not eliminate them from the scope of the present invention.

INDUSTRIAL APPLICABILITY

This invention is applicable to manufacture of the container packaged and filled up with the liquid food etc.

The invention claimed is:

1. An opening device for straws of a liquid food container which comprises a bottom and a main body formed with a packaging material laminated on both sides of a paper substrate with thermoplastic resin, and a top formed with thermoplastic resin and joined to an upper end of the main body;

an opening of the opening device for straws is integrally formed with the top and comprises a plurality of steps and level differences on a front side and a back side of the opening, the level differences on the front side and the level differences on the back side are formed at edges of the level differences of the back side and the front side with overlaps, lengths of the overlaps of the edges of the level differences are thinner than thickness of the steps, the level differences are easy fracture parts, a projection is located on the front side of one of the steps and projects away from the front side of the one step, the steps have 190%-650% of thickness to the lengths of the overlaps of the edges, and the overlap of the edge is 0.09-0.11 millimeter in length.

2. The opening device for the straws according to claim 1, the step on the front side of the opening is flat on the surface, and the step on the back side of the opening is flat on the surface.

3. The opening device for the straws according to claim 1, the step on the front side of the opening is roundish on the surface, and the step on the back side of the opening is roundish on the surface.

4. The opening device for the straws according to claim 1, the step on the front side of the opening is rounded on the surface, and the step on the back side of the opening is flat on the surface.

5. The opening device for the straws according to claim 1, the thermoplastic resin by which the top is formed, and the thermoplastic resin which is laminated on the paper substrate of an packaging material consist of the same or different kind of low density polyethylene.

6. An opening device for straws of a liquid food container, the liquid food container comprising a bottom and a main body formed with a packaging material, and a top formed with thermoplastic resin and joined to an upper end of the main body, the packaging material being a paper substrate laminated on both sides with thermoplastic resin, the top comprising:

an opening integrally formed with the top, the opening having a plurality of steps and level differences on a front side of the opening and a back side of the opening, each of the plurality of steps having a laterally extending outwardly facing surface, each step possessing a thickness, the level differences being easy fracture parts;

a plurality of overlaps formed at edges of the level differences of the front side and the level differences of the back side that overlap, the overlaps having a length that is less than the thickness of the steps;

a projection located on one of the steps and projecting away from the outwardly facing surface of the one step so that a portion of the outwardly facing surface of the one step surface extends laterally beyond the projection;

each step having a thickness of 190%-650% to the lengths of the overlaps; and each overlap having a length of 0.09-0.11 millimeters.

* * * * *